US009448522B2

(12) United States Patent
Sato

(10) Patent No.: US 9,448,522 B2
(45) **Date of Patent: *Sep. 20, 2016**

(54) IMAGE FORMING APPARATUS

(71) Applicant: Brother Kogyo Kabushiki Kaisha, Nagoya-shi, Aichi-ken (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/954,060

(22) Filed: Nov. 30, 2015

(65) Prior Publication Data

US 2016/0085198 A1 Mar. 24, 2016

Related U.S. Application Data

(63) Continuation of application No. 14/335,048, filed on Jul. 18, 2014, now Pat. No. 9,201,357, which is a continuation of application No. 13/955,303, filed on Jul. 31, 2013, now Pat. No. 9,091,973.

(30) Foreign Application Priority Data

Aug. 29, 2012 (JP) ..... 2012-188601

(51) Int. Cl.
*G03G 15/00* (2006.01)
*G03G 21/00* (2006.01)
(Continued)

(52) U.S. Cl.
CPC ..... *G03G 15/6552* (2013.01); *G03G 15/2028* (2013.01); *G03G 15/234* (2013.01); *G03G 15/6579* (2013.01); *G03G 21/1628* (2013.01); *G03G 21/1638* (2013.01)

(58) Field of Classification Search
CPC ..... B65H 85/00; G03G 15/00; G03G 21/00; G03G 15/6579; G03G 15/2028; G03G 21/1628; G03G 21/16; G03G 21/1638
USPC ..... 399/401
See application file for complete search history.

(56) References Cited

U.S. PATENT DOCUMENTS 4,711,550 A 12/1987 Sumida et al.
4,758,862 A 7/1988 Fukae et al.
(Continued)

FOREIGN PATENT DOCUMENTS

JP H01-164242 A 11/1989
JP H01-274160 A 11/1989
(Continued)

OTHER PUBLICATIONS

Mar. 8, 2016—(JP) Notice of Reasons for Rejection—App 2012-188601.

*Primary Examiner* — Nguyen Ha
*Assistant Examiner* — Wyn' Ha
(74) *Attorney, Agent, or Firm* — Banner & Witcoff, Ltd.

(57) ABSTRACT

An image forming apparatus with a duplex printing function may include a closeable and openable portion. In one example, the portion may correspond to a cover of the image forming apparatus. The cover may include guiding portions configured to define a return path for duplex printing. In another example, the portion may correspond to a document reading unit including an outer casing. A portion of the outer casing may be configured to guide a recording sheet that is conveyed out of a housing of the image forming apparatus by a switchback roller. In one example, the switchback roller may convey a recording sheet to a position above an upper surface of the outer casing.

10 Claims, 11 Drawing Sheets

(51) Int. Cl.

| | |
|---|---|
| ***B65H 85/00*** | (2006.01) |
| ***G03G 15/23*** | (2006.01) |
| ***G03G 21/16*** | (2006.01) |
| ***G03G 15/20*** | (2006.01) |

(56) References Cited

U.S. PATENT DOCUMENTS

| | | | | |
|---|---|---|---|---|
| 5,448,348 | A | 9/1995 | Azeta | |
| 5,974,283 | A | 10/1999 | Cho | |
| 6,128,463 | A | 10/2000 | Matsumoto et al. | |
| 6,330,425 | B1 | 12/2001 | Ohuchi et al. | |
| 6,622,002 | B2 | 9/2003 | Sawada | |
| 7,942,416 | B2 | 5/2011 | Muratani et al. | |
| 8,005,399 | B2 | 8/2011 | Sahara | |
| 8,036,590 | B2 | 10/2011 | Jang et al. | |
| 8,155,560 | B2 | 4/2012 | Sahara | |
| 8,662,657 | B2 | 3/2014 | Park et al. | |
| 9,201,357 | B2 * | 12/2015 | Sato | G03G 15/234 |
| 2003/0049043 | A1 | 3/2003 | Fuwazaki et al. | |
| 2003/0219293 | A1 | 11/2003 | Fujita et al. | |
| 2004/0207871 | A1 | 10/2004 | Ando | |
| 2005/0025544 | A1 | 2/2005 | Yamashita et al. | |
| 2007/0160381 | A1 | 7/2007 | Sato et al. | |
| 2008/0240781 | A1 | 10/2008 | Murano | |
| 2008/0298836 | A1 | 12/2008 | Sato | |
| 2008/0317498 | A1 | 12/2008 | Andoh et al. | |
| 2009/0067908 | A1 | 3/2009 | Muratani et al. | |
| 2009/0162122 | A1 | 6/2009 | Roppongi et al. | |
| 2010/0034559 | A1 | 2/2010 | Sahara | |
| 2011/0274464 | A1 | 11/2011 | Sahara | |
| 2013/0071166 | A1 | 3/2013 | Mori | |
| 2014/0064779 | A1 | 3/2014 | Sato | |

FOREIGN PATENT DOCUMENTS

| | | | |
|---|---|---|---|
| JP | H02239058 | A | 9/1990 |
| JP | H03-100565 | A | 4/1991 |
| JP | H03174170 | A | 7/1991 |
| JP | H05-027505 | A | 2/1993 |
| JP | H05-297662 | A | 11/1993 |
| JP | H07-257827 | A | 10/1995 |
| JP | 9068835 | A | 3/1997 |
| JP | 2000185880 | A | 7/2000 |
| JP | 2000185881 | A | 7/2000 |
| JP | 2001063892 | A | 3/2001 |
| JP | 2002-132051 | A | 5/2002 |
| JP | 2002338115 | A | 11/2002 |
| JP | 2004209924 | A | 7/2004 |
| JP | 2005-022825 | A | 1/2005 |
| JP | 2006131415 | A | 5/2006 |
| JP | 2007155905 | A | 6/2007 |
| JP | 2010-107798 | A | 5/2010 |
| JP | 2010260687 | A | 11/2010 |
| JP | 2012020845 | A | 2/2012 |
| JP | 5171465 | B2 | 3/2013 |

* cited by examiner

IMAGE FORMING APPARATUS

CROSS REFERENCE TO RELATED APPLICATION

This application is a continuation of U.S. patent application Ser. No. 14/335,048 filed Jul. 18, 2014, which is a continuation of U.S. patent application Ser. No. 13/955,303 filed Jul. 31, 2013, issued as U.S. Pat. No. 9,091,973 on Jul. 28, 2015, which claims priority from Japanese Patent Application No. 2012-188601, filed on Aug. 29, 2012, the entire disclosure of which is incorporated herein by reference.

BACKGROUND OF THE INVENTION

1. Field of the Invention

The present invention relates to an electrophotographic image forming apparatus.

2. Description of Related Art

In a known electrophotographic image forming apparatus, e.g., a laser printer, a process unit transfers a toner image onto a sheet fed from a feed tray, and a fixing unit thermally fixes the transferred toner image onto the sheet. Then the sheet having the toner image thereon is discharged onto a discharge tray. The process unit, the fixing unit, and the discharge tray are disposed above the feed tray and arranged from the rear toward the front in this order, thereby making the apparatus flat and compact in a height direction thereof.

Recently, there is a demand for a compact image forming apparatus which has a duplex printing function and in which a toner cartridge is readily replaceable.

SUMMARY OF THE INVENTION

Therefore, a need has arisen for providing an image forming apparatus which has a duplex printing function and in which a developing agent storage is readily replaceable while the size in a height direction of the image forming apparatus is prevented from increasing excessively.

According to an embodiment of the invention, an image forming apparatus comprises a housing having an opening, a feed tray configured to be received in the housing and to store recording sheets, a fixing unit configured to thermally fix a developing agent image onto a recording sheet, and a cover disposed above the housing and configured to move relative to the housing between a closed position in which the cover covers the opening and an open position in which the opening is exposed. The cover comprises a first guiding portion and a second guiding portion which define therebetween at least a portion of a return path along which the recording sheet conveyed from the fixing unit is guided back toward the fixing unit.

According to another embodiment of the invention, an image forming apparatus comprises a document reading unit including an outer casing, a housing on which the document reading unit is disposed, a feed tray configured to be received in the housing and to store recording sheets, and a fixing unit disposed in the housing and configured to thermally fix a developing agent image onto a recording sheet, and a switchback roller disposed in the housing and through which the recording sheet conveyed from the fixing unit is returned toward the fixing unit. The switchback roller is configured to convey the recording sheet out of the housing and into the housing. A portion of the outer casing is configured to guide the recording sheet to a position above an upper surface of the outer casing when the recording sheet is conveyed out of the housing by the switchback roller.

According to another embodiment of the invention, an image forming apparatus comprises a housing, a cover disposed above the housing, a feed tray configured to be received in the housing and to store recording sheets, a process unit configured to be disposed in the housing and to transfer a developing agent image onto a recording sheet fed from the feed tray, a fixing unit disposed in the housing and configured to thermally fix a developing agent image onto the recording sheet conveyed from the process unit in a sheet conveying direction, a guide portion disposed above the fixing unit and the process unit and defining at least a portion of a return path along which the recording sheet conveyed from the fixing unit is returned toward the process unit, and a switchback roller disposed upstream of the process unit in the sheet conveying direction and configured to convey the recording sheet returned along the return path out of the housing and into the housing. An upper surface of the cover is configured to receive a part of the recording sheet when the recording sheet is conveyed out of the housing by the switchback roller.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

DETAILED DESCRIPTION OF EMBODIMENTS

Embodiments of the invention and their features and technical advantages may be understood by referring to FIGS. 1-11, like numerals being used for like corresponding parts in the various drawings.

In the following description, the expressions "front", "rear", "upper (up)", "lower (down)", "right", and "left" are used to define the various parts when an image forming apparatus, e.g., a laser printer 1, is disposed in an orientation in which it is intended to be used.

General Structure of Laser Printer

Figure 1:
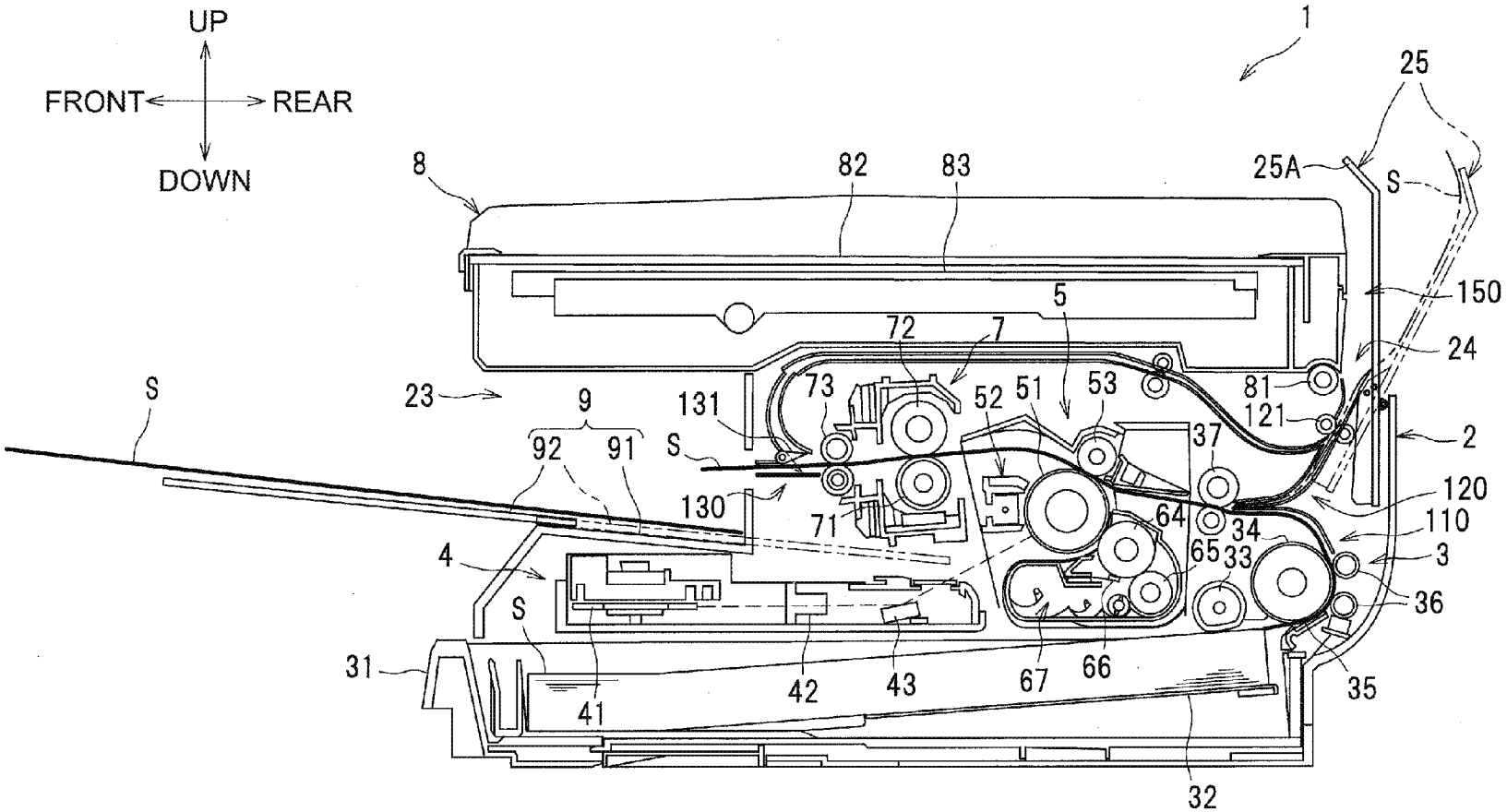
FIG. 1 is a cross-sectional view of a laser printer as an example of an image forming apparatus according to an embodiment of the invention.

The general structure of the laser printer 1 according to an embodiment of the invention will be described. As shown in FIG. 1, the laser printer 1 comprises a housing 2, a top cover 8 disposed on the housing 2, and a feed unit 3, an exposure unit 4, and a process unit 5 which are disposed inside the housing 2.

The housing 2 has a replacement opening 21 (shown in FIG. 2) formed at an upper portion thereof for replacing the process unit 5. A discharge tray 9 is disposed forward of the replacement opening 21 to receive a recording sheet, e.g., a sheet S, discharged from the fixing unit 7.

The feed unit 3 is configured to feed a sheet S to the process unit 5 and comprises a feed tray 31 configured to store sheets S, a sheet pressing plate 32, a feed roller 33, a separation roller 34, a separation pad 35, convey rollers 36, and a registration roller 37. The sheet pressing plate 32 presses the sheets S in the feed tray 31 to the feed roller 33. The feed roller 33 feeds the sheets S toward the separation roller 34. The separation roller 34 and the separation pad 35 separate the sheets S one by one. The separation roller 34, the convey rollers 36, and the registration roller 37 convey a separated sheet to the process unit 5.

The exposure unit 4 is configured to expose a photosensitive drum 51 of the process unit 5 to light and comprises a laser light source (not shown), a polygon mirror 41, a lens 42, and a reflection mirror 43. A laser beam (shown by a broken line) emitted from the laser light source is reflected by or passes through the polygon mirror 41, the lens 42, and the reflection mirror 43, in this order, and is scanned on a surface of the photosensitive drum 51 at high speed.

The process unit 5 is configured to transfer a developing agent image, e.g., a toner image, onto the sheet S fed from the feed tray 31. The process unit 5 comprises the photosensitive drum 51, a charger 52, a transfer roller 53, a developing roller 64, a supply roller 65, a blade 66, and a developing agent storage 67 for storing a developing agent, e.g., toner. In the process unit 5, the surface of the photosensitive drum 51 is uniformly charged by the charger 52 and then is exposed to the laser light emitted from the exposure unit 4. As a result, an electrostatic latent image is formed on the photosensitive drum 51. The toner in the developing agent storage 67 is supplied by the supply roller 65 to the developing roller 64, and is carried on the developing roller while the blade 66 in sliding contact with the developing roller 64 regulates the thickness of a layer of toner. When the toner on the developing roller 64 is supplied to the photosensitive drum 51, the electrostatic latent image is visualized as a toner image formed on the photosensitive drum. Then the toner image on the photosensitive drum 51 is transferred onto the sheet S when the sheet S fed by the feed unit 3 passes between the photosensitive drum 51 and the transfer roller 53.

The fixing unit 7 is configured to thermally fix the toner image onto the sheet S conveyed from the process unit 5 and comprises a heat roller 71 and a pressure roller 72. The toner image is thermally fixed onto the sheet S when the sheet S having a transferred toner image passes between the heat roller 71 and the pressure roller 72. The sheet having a fixed image thereto is discharged by the discharge roller 73 onto the discharge tray 9.

The top cover 8 is configured to pivot relative to the housing 2 between a closed position (shown in FIG. 1) and an open position (shown in FIG. 2) about a pivot shaft 81 disposed at a rear portion thereof such that a front portion thereof moves vertically relative to the housing 2. The top cover 8, when in the closed position, covers the replacement opening 21 and, when in the open position, exposes the replacement opening 21 to the outside. The top cover 8 comprises a document reading unit, e.g., an image sensor 83, configured to read an image of a document placed on a document table 82 and to generate an image data. The top cover 8 functions as a flat-bed scanner. The top cover 8 may further comprise an automatic document feeder (ADF).

Detailed Structure of Laser Printer

The detailed structure of the laser printer 1 will now be described. As shown in FIG. 1, the registration roller 37, the process unit 5, the fixing unit 7, and the discharge tray 9 are disposed above the feed tray 31 and are arranged in a horizontal direction in this order from the rear of the laser printer 1 toward the front of the laser printer 1.

Figure 3A:
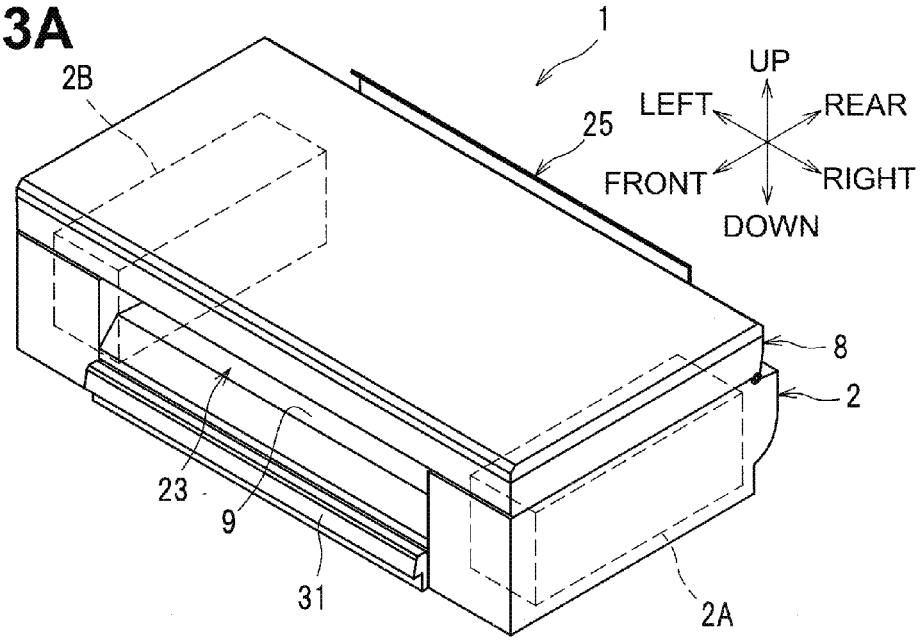
FIG. 3A is a perspective view of the laser printer with a feed tray attached.
Figure 3B:
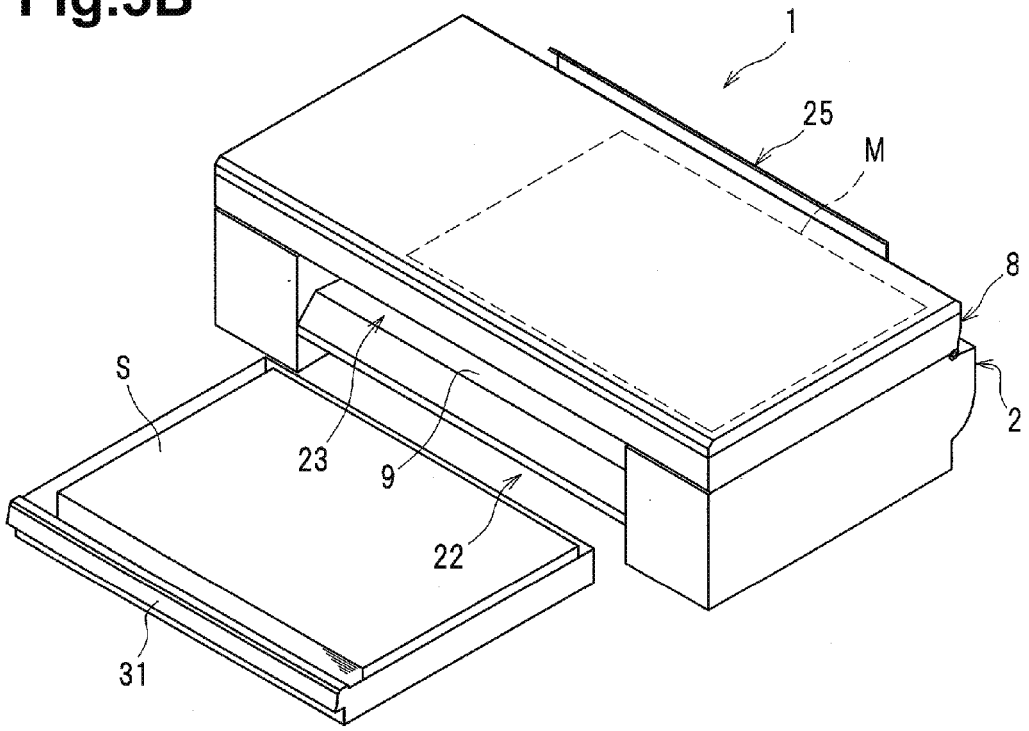
FIG. 3B is a perspective view of the laser printer with the feed tray removed.
Figure 4:
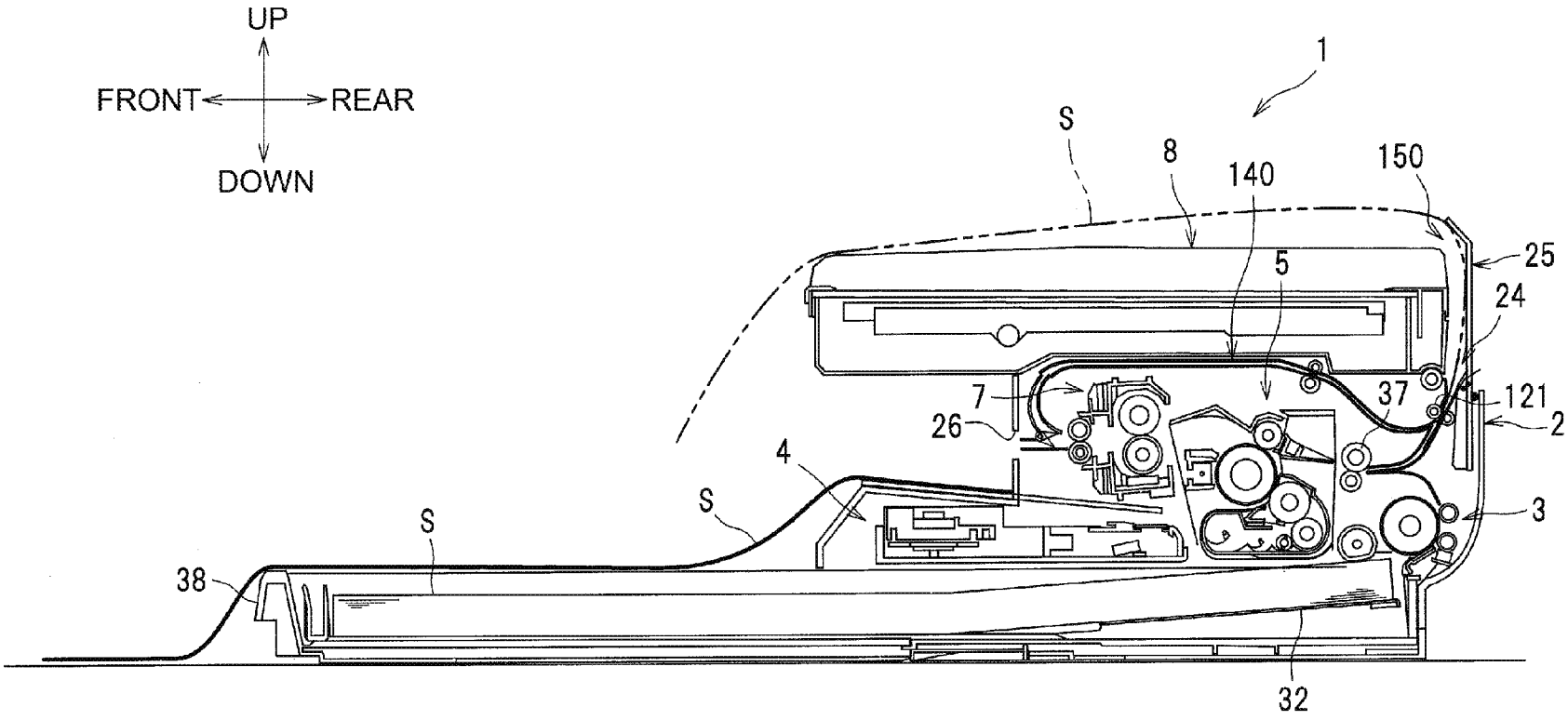
FIG. 4 is a cross-sectional view of the laser printer with the feed tray attached.

The feed tray 31 has a substantially box shape with its top open. As shown in FIGS. 3A and 3B, the feed tray 31 is removably attached to a tray mount 22. As shown in FIG. 3B, the feed tray 31 is configured to store sheets S of A4 size (210 mm×297 mm) with their length oriented in a left-right direction. As shown in FIG. 4, an optional feed tray 38, which has a greater dimension in a front-rear direction than that of the feed tray 31 and is configured to store sheets S of A3 size (297 mm×420 mm), may be removably attached to the tray mount 22.

Referring back to FIG. 3A, a drive unit 2A and a power unit 2B are disposed respectively on right and left sides of the feed tray 31 in the housing 2. Specifically, the drive unit 2A and the power unit 2B are disposed respectively on right and left sides of the feed unit 3, exposure unit 4, process unit, 4, and the fixing unit 7. The drive unit 2A is configured to drive the process unit 5 and the fixing unit 7 and comprises a motor (not shown), a plurality of gears (not shown), and a coupling (not shown) for inputting a driving force to the process unit 5 and the like. The power unit 2B is configured to provide electric power to the process unit 5 and the fixing unit 7, and comprises a power substrate (not shown) and electrodes (not shown) electrically connected to electrodes of the process unit 5 and the like.

As shown in FIG. 3B and FIG. 1, the top cover 8 is disposed on the housing 2 so as to cover the process unit 5, the fixing unit 7, the discharge tray 9, the drive unit 2A, and the power unit 2B. In the top cover 8 configured as a flat-bed scanner, an A4-size document M is to be placed on the document table with its length oriented in the left-right direction. The image sensor 83 is configured to read an image of the document M while moving in the left-right direction.

In the laser printer 1, the orientation of an A4-size document M placed on the document table 82 is the same as the orientation of A4-size sheets stored in the feed tray 31. This allows the dimensions of the housing in the front-rear direction and in the left-right direction to be substantially the same as those of the top cover 8. The flat-bed scanner does not protrude relative to the housing 2 in the left-right direction, nor the housing 2 does not protrude relative to the flat-bed scanner in the front-rear direction, unlike a laser printer in which an A4-size document is placed on a document table with its length oriented in the left-right direction and A4-size sheets are stored in a feed tray with their length oriented in the front-rear direction. Thus, the laser printer 1 has a relatively small dimension in the front-rear direction and has a compact external shape which is substantially rectangular parallelepiped.

The discharge tray 9 is disposed in a recessed portion 23 formed in a center of a front upper portion of the housing 2 in the left-right direction. The recessed portion 23 is formed as an external periphery of the housing 2. As shown in FIG. 1, the discharge tray 9 comprises a base portion 91, which defines a lower part of the recessed portion 23, and an extendible portion 92. The extendible portion 92 has a substantially flat plate shape and is movable between a stored position shown by a two-dot-one-dash line and an extended position shown by a solid line. The extendible portion 92 is pulled forward from the stored position to the extended position. The extendible portion 92 has such a length in the front-rear direction that a front end of the extendible portion 92 in the stored position is substantially aligned with a front end of the base portion 91 and a rear end of the extendible portion 92 in the stored position reaches a position right below the fixing unit 7.

Figure 2:
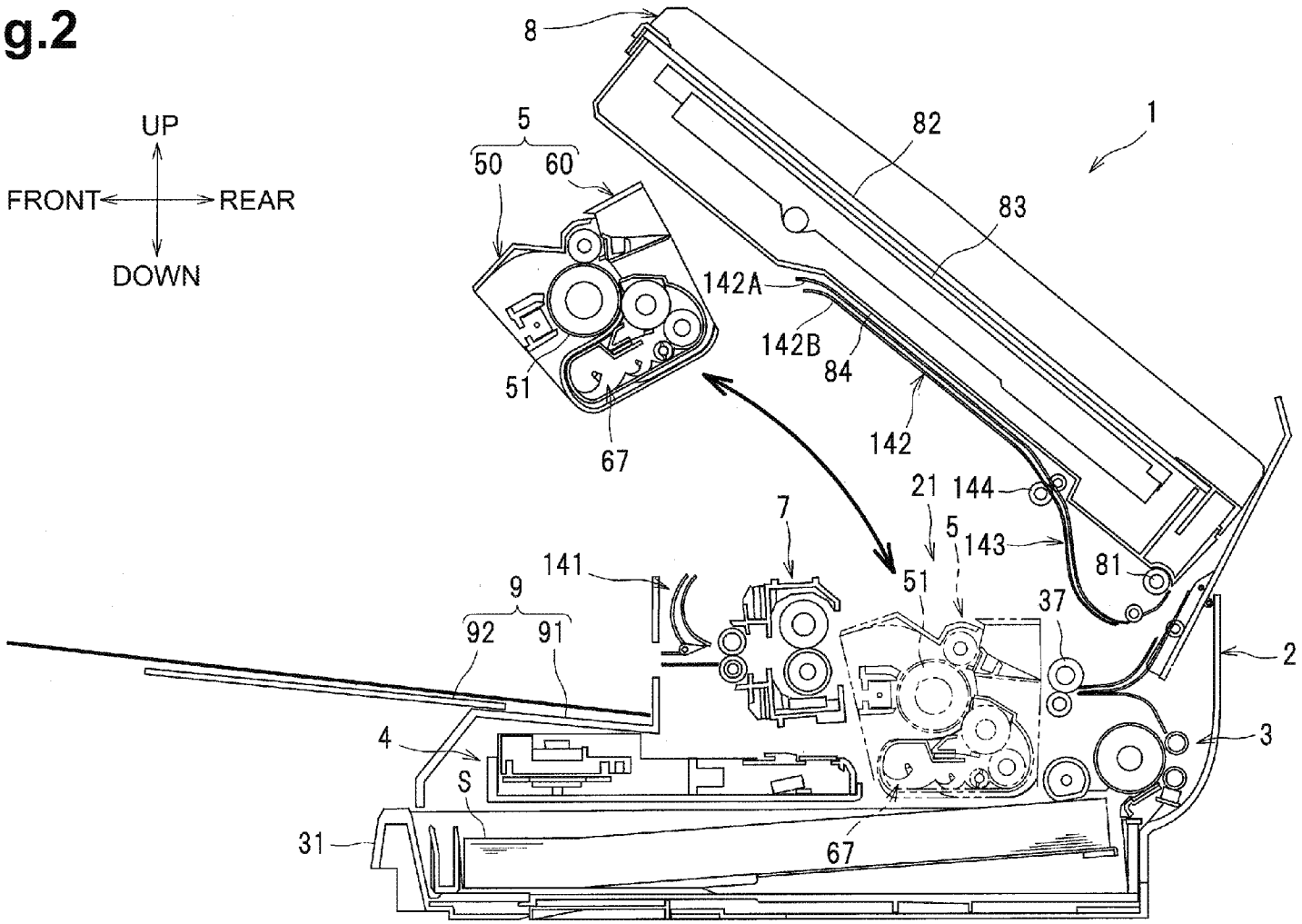
FIG. 2 is a cross-sectional view of the laser printer with a top cover in an open position.

As shown in FIG. 2, the process unit 5 is attachable to and removable from the housing 2 through the replacement opening 21 when the top cover 8 is in the open position. The process unit 5 comprises a photosensitive unit 50 and a developing unit 60 which is removably attached to the photosensitive unit 50. Specifically, the developing unit is removably attached to a photosensitive unit frame 54, as will be described later.

Figure 5:
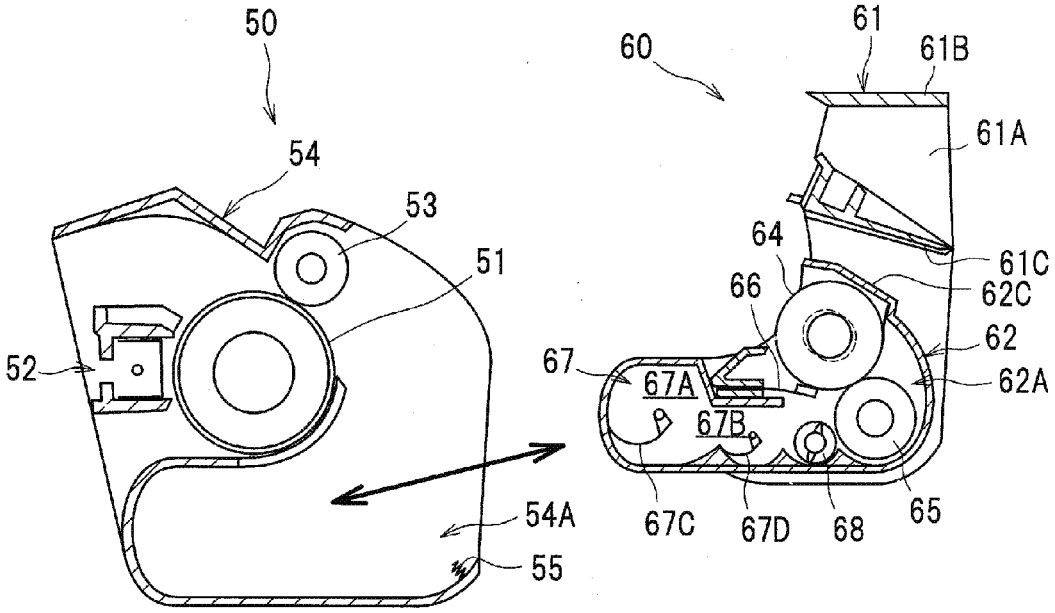
FIG. 5 is a cross-sectional view of a photosensitive unit and a developing unit.

As shown in FIG. 5, the photosensitive unit 50 comprises the photosensitive drum 51, the charger 52, the transfer roller 53, and the photosensitive unit frame 54. The photosensitive unit frame 54 is a frame of the photosensitive unit 50 including the charger 52 and rotatably supports the photosensitive drum 51 and the transfer roller 53. The photosensitive unit frame 51 comprises a mount 54A formed in a lower portion thereof and on a lower side of the photosensitive drum 51. The developing unit 60, which is substantially L-shaped, is removably attached to the mount 54A.

The developing unit 60 comprises the developing roller 64, the supply roller 65, the blade 66, the developing agent storage 67, and an auger 68 for conveying the toner in the left-right direction. The developing unit 60 comprises a first frame 61 and a second frame 62 which are formed as separate members.

The second frame 62 is shaped like a container having an opening through which a part of the developing roller 64 is exposed upward. The second frame 62 rotatably supports the developing roller 64 and the auger 68, and is formed with the developing agent storage 67. Also, the second frame 62 is formed with a developing chamber 62A on the rear side (i.e. right side in FIG. 5) of the developing agent storage 67. The developing roller 64, the supply roller 65, the blade 66, and the auger 68 are disposed in the developing chamber 62A.

Figure 7:
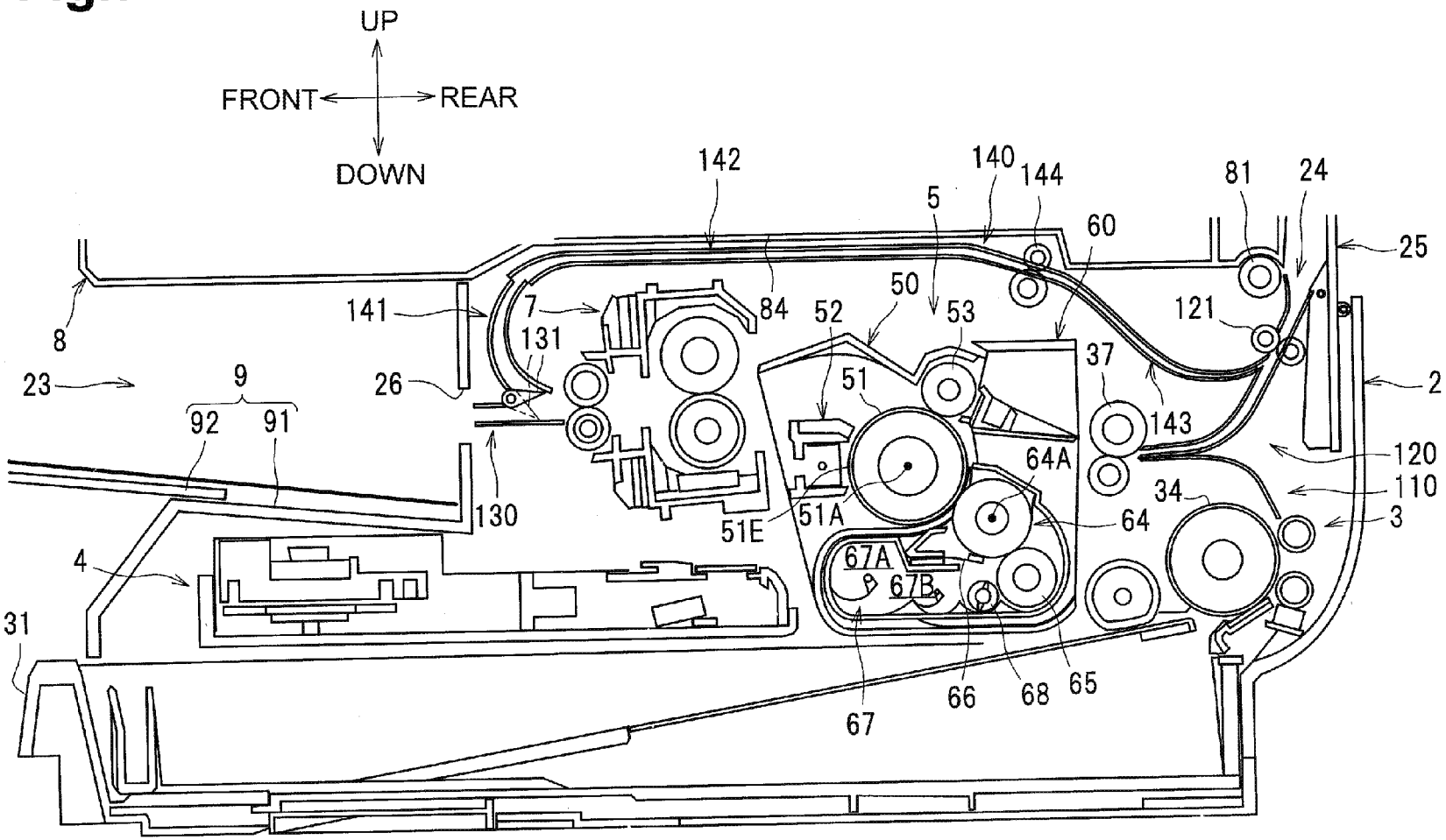
FIG. 7 is an enlarged view of the laser printer shown in FIG. 1.

The developing agent storage 67 comprises a first chamber 67A and a second chamber 67B into which the toner is supplied from the first chamber 67A. The second chamber 67B is disposed on the rear side (i.e., right side in FIG. 5) of the first chamber 67A and has a smaller capacity than the first chamber 67A. An agitator 67C is disposed in the first chamber 67A to stir and convey the toner to the second chamber 67B. An agitator 67D is disposed in the second chamber 67B to stir and convey the toner to the developing chamber 62A. As shown in FIG. 7, when the process unit 5 is attached in the housing 2, the first chamber 67A of the developing agent storage 67 extends, in a sheet conveying direction, to a position downstream of a downstream end 51E of the photosensitive drum 51. Specifically, the first chamber 67A extends beyond the downstream end 51E to a position right below the charger 52. Hereinafter, it is to be understood that when the term "sheet conveying direction" is used, it refers to the sheet conveying direction in which the sheet S is conveyed from the process unit 5 through the fixing unit 7 toward the discharge tray 9.

Referring back to FIG. 5, the first frame 61 comprises a pair of side frames 61A (only one of the side frames is shown in FIG. 5), a first connecting wall 61B, and a second connecting wall 61C. Each of the first connecting wall 61B and the second connecting wall 61C extends in the left-right direction and connects upper portions of the side frames 61A. The side frames 61A are disposed on right and left sides of the second frame 62. The first frame 61 is removably attached to the mount 54A of the photosensitive unit frame 54. When the first frame 61 is attached to the photosensitive unit frame 54, the developing unit 60 is attached into a fixed position on the photosensitive unit frame 54.

The first connecting wall 61B and the second connecting wall 61C are disposed while leaving a predetermined distance therebetween vertically. The first connecting wall 61B above the second connecting wall 61C is configured to be held by hand when the developing unit 60 is attached to and removed from the photosensitive unit frame 54. In other words, the first connecting wall 61B is provided to the first frame 61 as a handle to be held by hand for attaching and removing the developing unit 60.

Figure 6:
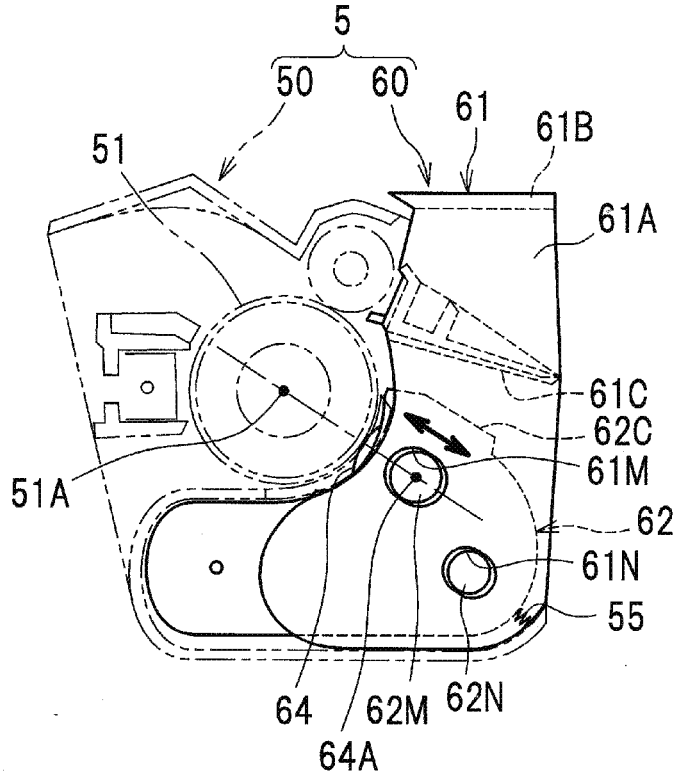
FIG. 6 is a side view of the developing unit.

As shown in FIG. 6, each of right and left side faces (only one of the side faces is shown in FIG. 6) of the second frame 62 comprises cylindrical protrusions 62M, 62N which are coaxial with axes of the developing roller 64 and the supply roller 65, respectively, and protrude rightward or leftward. Each of the side frames 61A (only one of the side frames is shown in FIG. 6) of the first frame 61 has support holes 61M, 61N in correspondence with the protrusions 62M, 62N, respectively. The second frame 62 is supported by the first frame 61 while the protrusions 62M, 62N are engaged into the support holes 61M, 61N. Each of the support holes 61M, 61N is substantially oval and elongated along a one-dot-one-dash line connecting an axis 64A of the developing roller 64 and an axis 51A of the photosensitive drum 51. Thus, the second frame 62 is supported with play movably along the one-dot-one-dash line relative to the first frame 61.

The second frame 62 has play relative to the first frame 61 which is fixed to the photosensitive unit frame 54. The photosensitive unit 50 comprises an urging member 55 which urges the second frame 62 toward the photosensitive drum 51. When the developing unit 60 is attached to the photosensitive unit 50, the developing roller 64 supported by the second frame 62 makes contact with the photosensitive drum 51 while being urged by the urging member 55 toward the photosensitive drum 51.

In the process unit 5, the first frame 61 is attached to and removed from the photosensitive unit frame 54 in an attaching and removing direction shown by a double-headed arrow in FIG. 5, and the second frame 62 moves relative to the first frame 61 in a moving direction shown by a double-headed arrow in FIG. 6. The attaching and removing direction crosses the moving direction. This prevents or reduces rattle between the photosensitive unit frame 54 and the developing unit 60 in the attaching and removing direction while ensuring the movement of the second frame 62 relative to the first frame 61 and the movement of the developing roller 64 relative to the photosensitive drum 51.

Referring back to FIG. 5, the second connecting wall 61C of the first frame 61 and an opposite wall 62C, which belongs to the second frame 62 and is opposite to the second connecting wall 61C, are disposed while leaving a predetermined clearance therebetween vertically. The sheet S fed from the feed tray 31 passes through the clearance. A lower surface of the second connecting wall 61C, which faces an upper surface of the sheet S, and an upper surface of the opposite wall 62C, which faces a lower surface of the sheet S, guide the sheet S toward the photosensitive drum 51. The second connecting wall 61C and the opposite wall 62C are provided to the developing unit 60 as a conveying guide which guides the sheet S toward the photosensitive drum 51.

The layout of various parts of the process unit 5 and the exposure unit 4 when the process unit 5 structured as described above is attached in the housing 2 will be described. Advantages of such layout will also be described.

As shown in FIG. 7, the photosensitive drum 51 is disposed at substantially the center of the process unit 5 as viewed from the right or left side. The charger 52 in the process unit 5 is disposed forward of the photosensitive drum 51, i.e., downstream of the photosensitive drum 51 in the sheet conveying direction. The transfer roller 53 in the process unit 5 is disposed rearward of the axis 51A of the photosensitive drum 51, i.e., upstream of the axis 51A in the sheet conveying direction, and disposed diagonally upward of the photosensitive drum 51.

The developing agent storage 67 is disposed below the photosensitive drum 51. More specifically, the developing agent storage 67 is disposed vertically downward of the photosensitive drum 51. A space which is above the feed tray 31 and is occupied by the process unit 5 can be reduced as compared with the structure where a developing agent storage and a photosensitive drum are arranged in the front-rear direction. Thus, the length of the base portion 91, i.e., the length of a portion belonging to the discharge tray 9 and located right above the feed tray 31 can be sufficiently ensured without increasing the size of the housing 2 in the front-rear direction.

Because the length of the base portion 91 of the discharge tray 9 is sufficiently ensured, the extending length of the extendible portion 92 from the housing 2 can be reduced when the extendible portion 92 is in the extended position. The feed tray 31 of the laser printer 1 is configured to store A4-size sheets S with their length oriented in the left-right direction. Although the dimension of the housing 2 in the front-rear direction is relatively smaller than that of a printer configured to store A4-size sheets with their length oriented in the front-rear direction, a sufficient length of the base portion 91 of the discharge tray 9 can be ensured because the developing agent storage 67 is disposed below the photosensitive drum 51.

The developing roller 64 is disposed rearward of the axis 51A of the photosensitive drum 51 and diagonally downward of the photosensitive drum 51. A space which is above the feed tray 31 and is occupied by the process unit 5 can be reduced as compared with the structure where a developing roller and a photosensitive drum are arranged in the front-rear direction. Thus, the length of the base portion 91 of the discharge tray 9 can be sufficiently ensured.

The supply roller 65 is disposed side by side with the developing agent storage 67 horizontally and is disposed diagonally downward of the developing roller 64 on an upstream side of, i.e., a rear side of, the axis 64A of the developing roller 64 in the sheet conveying direction. A space which is above the feed tray 31 and is occupied by the process unit 5 can be reduced as compared with the structure where a supply roller and a developing roller are arranged in the front-rear direction. Thus, the length of the base portion 91 of the discharge tray 9 can be sufficiently ensured.

The blade 66 in the process unit 5 extends in the sheet conveying direction and comprises a contact portion (reference number omitted) at a free end (i.e., rear end) thereof. The contact portion, which may be made of rubber, is in contact with a lower portion of the developing roller 64. The auger 68 is disposed below the developing roller 64 (below a contact portion between the developing roller 64 and the blade 66) and between the supply roller 65 and the developing agent storage 67. This allows the auger 68 to efficiently disperse the toner scraped down from the developing roller 64 by the blade 66. The toner is conveyed from the first chamber 67A at a first location below the photosensitive drum 51 to the supply roller 65 at a second location. The second location is upstream of the first location in the sheet conveying direction and is farther from the photosensitive drum 51 than the first location. The developing agent storage 67 extends beyond the photosensitive drum 51 in a direction opposite to a direction in which the toner is conveyed from the developing agent storage 67 to the supply roller 65.

The exposure unit 4 is disposed forward of the developing agent storage 67, i.e., downstream of the developing agent storage 67 in the sheet conveying direction, while being horizontally adjacent to the developing agent storage 67. In other words, the exposure unit 4 is disposed at a position distinct from, in the sheet conveying direction, a position where the process unit is located. The exposure unit 4 is disposed below the fixing unit 7 and the discharge tray 9 and above the feed tray 31. The housing 2, i.e., the laser printer 1, can be made flat and compact in a height direction, as compared with the structure where an exposure unit is disposed below a process unit.

Conveying paths of the sheet S defined in the housing 2 will now be described. As shown in FIG. 7, the laser printer 1 is configured to form an image on both sides of the sheet S. A first feed path 110, a second feed path 120, a discharge path 130, and a return path 140 are defined in the laser printer 1. Each path is defined by wall-shaped or rib-shaped guides (reference numbers omitted) each of which faces a corresponding print side of the conveyed sheet S. The sheet S of A4 size is guided along the path in the same orientation as that stored in the feed tray 31. Specifically, the sheet of A4 size is guided along the path with its length oriented in the left-right direction.

The sheet stored in the feed tray 31 is guided along the first feed path 110 toward the process unit 5. The first feed path 110 extends diagonally upward and rearward from rear ends of the sheets S stored in the feed tray 31, curves frontward along a circumferential surface of the separation roller 34, and extends toward the registration roller 37 (process unit 5).

The sheet S set in a manual insertion opening 24 is guided along the second feed path 120 toward the process unit 5. The sheet S is fed from the outside of the housing 2 through the manual insertion opening 23 toward the process unit 5. The manual insertion opening 24 is formed upstream of the process unit 5 in the sheet feed direction and specifically at an upper rear end of the housing 2 so as to be open diagonally rearward and upward. The second feed path 120 extends from the manual insertion opening 24 diagonally frontward and downward and curves frontward toward the registration roller 37 (process unit 5). A switchback roller 121 is disposed below and in the vicinity of the pivot shaft 81 of the top cover 8 and is configured to selectively rotate in a forward direction to convey the sheet S toward the process unit 5 and in a reverse direction to convey the sheet S to the outside of the housing 2 through the manual insertion opening 24.

As shown in FIG. 1, a sheet guide, e.g., a manual feed tray 25, is disposed in the rear of the housing 2. The manual feed tray 25 is movable relative to the housing 2 between a vertical position shown by a solid line and an inclined position shown by a two-dot-one-dash line. The manual feed tray 25 is pivotable rearward from the vertical position to the inclined position so as to hold, from below, the sheet S set in the manual insertion opening 24. A predetermined clearance is formed between the manual feed tray 25 in the vertical position and the top cover 8. The manual feed tray 25 comprises, at an upper portion thereof, a guide portion 25A. When the manual feed tray 25 is in the vertical position, the guide portion 25A is located above the top cover 8 and is bent frontward so as to extend diagonally upward. At this time, a switchback path 150 is formed so as to extend upward from the switchback roller 121 (manual insertion opening 24), bend forward, and open toward an upper surface of the top cover 8.

Referring back to FIG. 7, the sheet S discharged from the fixing unit 7 is guided along the discharge path 130 toward the discharge tray 9 outside the housing 2. The discharge path 130 extends in the front-rear direction and communicates with a discharge opening 26.

The sheet S discharged from the fixing unit 7 is guided back along the return path 140 toward the process unit 5. The return path comprises a first path 141, a second path 142, and a third path 143. The first path 141 branches from an upstream side of the discharge path 130, extends diagonally upward and frontward, and bends rearward. The second path 142 extends from the first path 141 substantially horizontally and passes above the fixing unit 7 and the process unit 5. The third path 143 continues from the second path 142, extends diagonally downward and rearward while passing above the registration roller 37, and bends diagonally upward and rearward toward the switchback roller 121 (manual insertion opening 24). A convey roller 144 for conveying the sheet S is disposed between the second path 142 and the third path 143.

As shown in FIG. 2, the second path 142 and the third path 143, each of which is a part of the return path 140, is formed in a lower portion of the top cover 8 such that the replacement opening 21 is exposed when the top cover is in the open position. The top cover 8 comprises, at a lower portion thereof, a first guide 142A and a second guide 142B which define the second path 142 therebetween. The first guide 142A and the second guide 142B are disposed in a recess 84 formed on a lower side of the top cover 8.

As shown in FIG. 7, a flapper 131 is disposed at the junction of the discharge path 130 and the return path 140 so as to vertically pivot about a front end thereof. The flapper 131 is controlled to pivot upward to a position shown by a solid line when the sheet S discharged from the fixing unit 7 is discharged onto the discharge tray 9 upon the completion of image forming. The flapper 131 is controlled to pivot downward to a position shown by a dotted line when the sheet S having an image on one side thereof and discharged from the fixing unit 7 is guided again to the process unit 5. The process unit 5 forms an image on the other side of the sheet S.

Image forming by the laser printer 1 on both sides of the sheet S and the advantages thereof will now be described. As shown in FIG. 1, the feed roller 33 feeds the sheet S stored in the feed tray 31 toward the process unit 5 along the first feed path 110. The switchback roller 121, which rotates in the forward direction, feeds the sheet S set in the manual insertion opening 24 toward the process unit 5 along the second feed path 120. The process unit 5 transfers a toner image onto the sheet S passing through the process unit 5. The fixing unit 7 thermally fixes the toner image onto the sheet S, thereby forming the image on one side of the sheet S.

Figure 8:
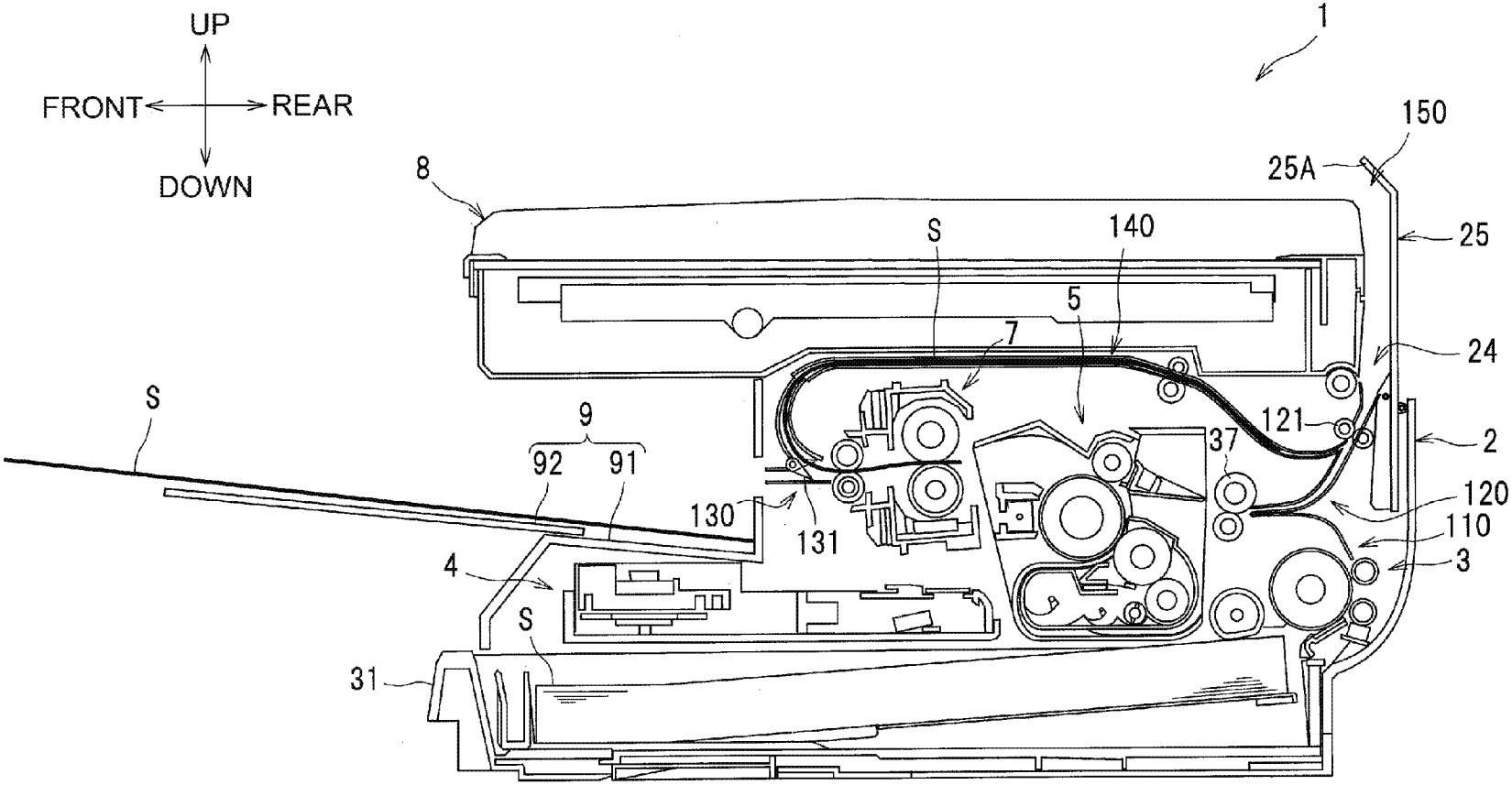
FIG. 8 is a view of the laser printer in which a sheet discharged from a fixing unit is guided to a return path.

When image forming is completed, the sheet S discharged from the fixing unit 7 is guided to the discharge path 130 by the flapper 131 pivoted upward and is discharged onto the discharge tray 9. On the other hand, as shown in FIG. 8, when an image is formed on the other side of the sheet S, the sheet S discharged from the fixing unit 7 is guided to the return path 140 by the flapper 131 pivoted downward and is conveyed above the fixing unit 7 and the process unit 5, along the return path 140, toward the switchback roller 121.

Figure 9:
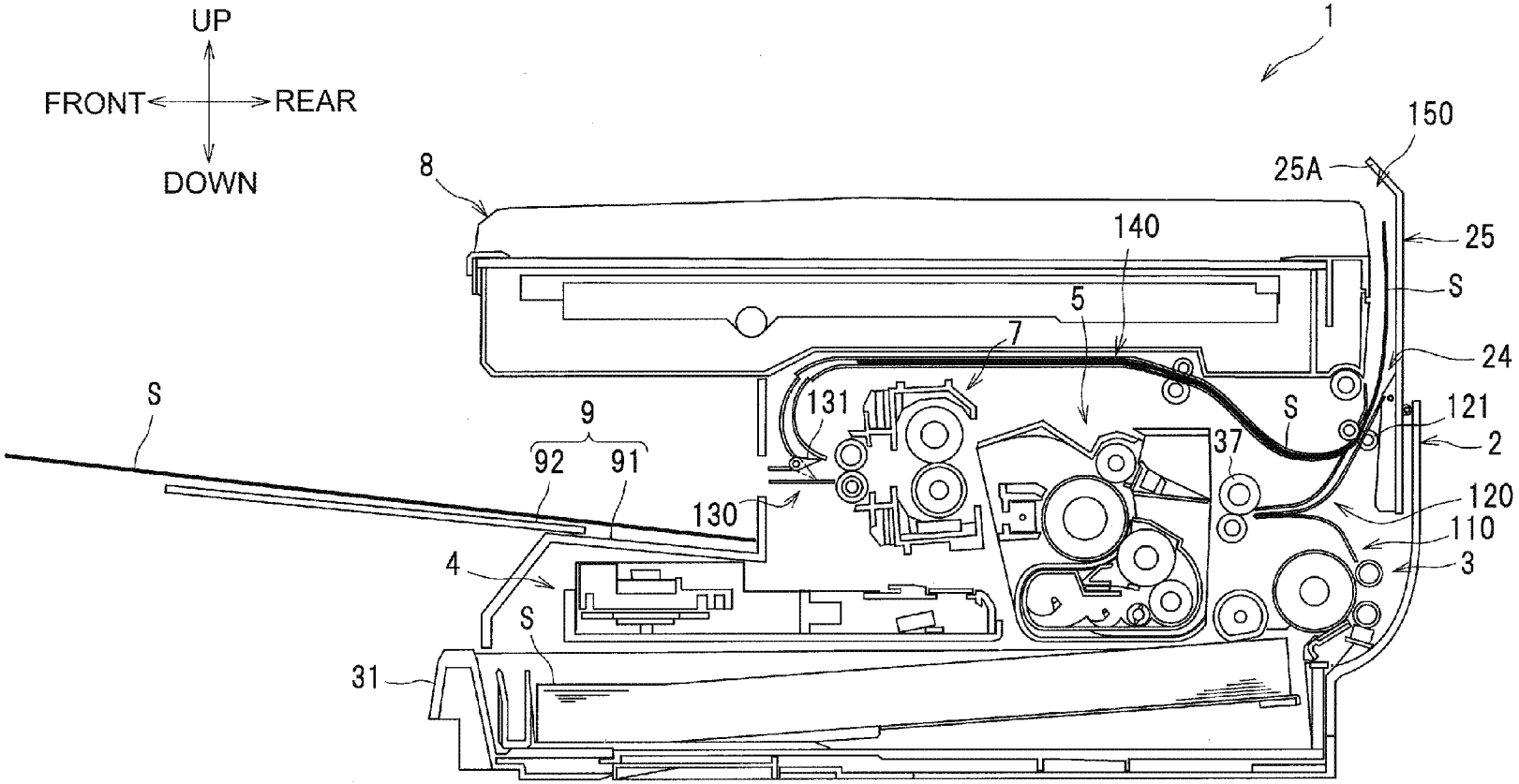
FIG. 9 is a view of the laser printer in which the sheet conveyed along the return path is discharged from a manual feed opening to the outside of a housing.
Figure 10:
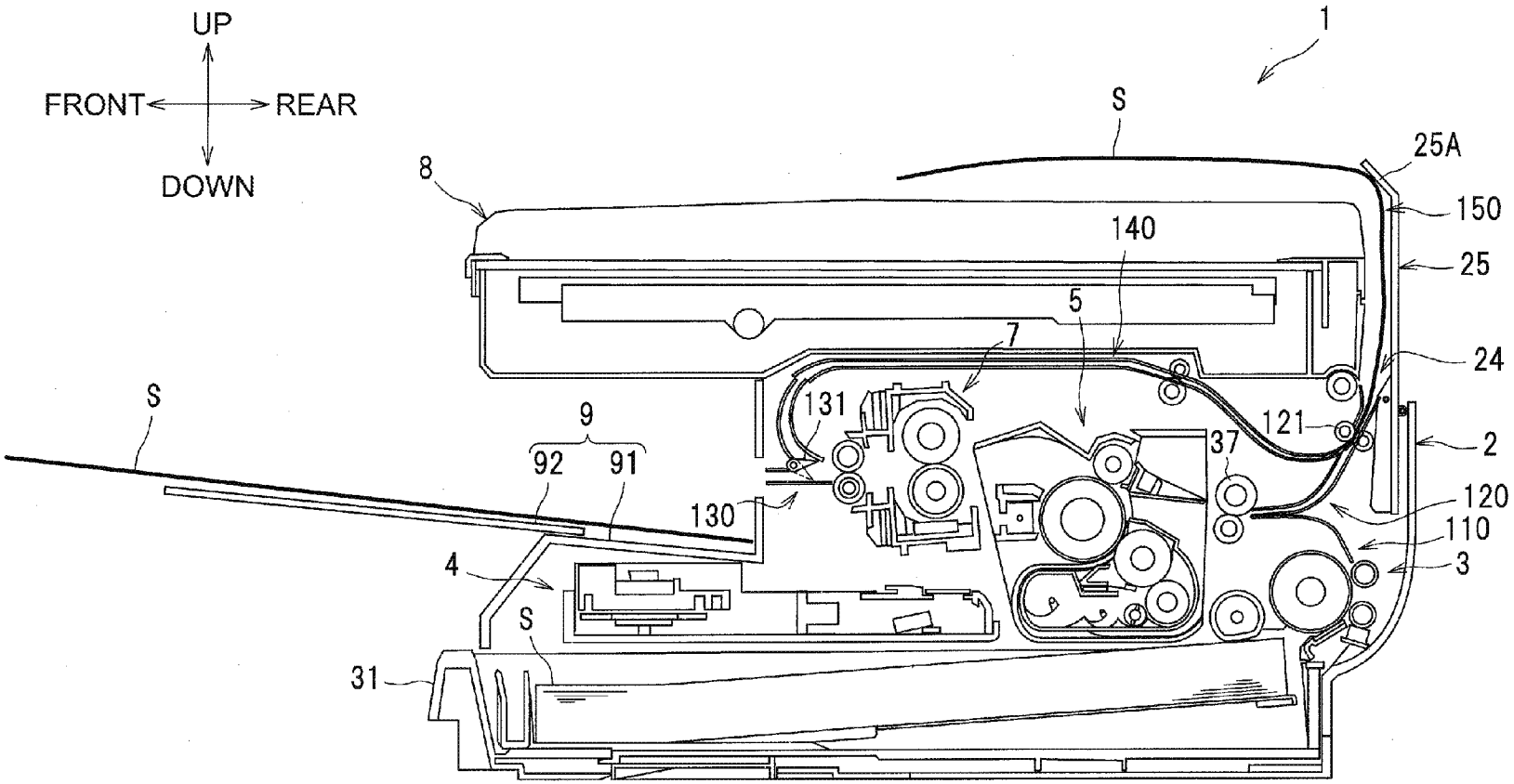
FIG. 10 is a view of the laser printer in which the sheet discharged from the manual feed opening is placed on a top cover.

As shown in FIG. 9, when the sheet S reaches the switchback roller 121, the switchback roller 121, which rotates in the reverse direction, discharges the sheet S through the manual insertion opening 24 to the outside of the housing 2. As shown in FIG. 10, the sheet S discharged out of the housing 2 is guided along the switchback path 150, which is defined between the manual feed tray 25 and the top cover 8, and is directed frontward by the guide portion 25A, thereby being discharged onto the top cover 8. The switchback roller 121 rotates in the forward direction when a trailing edge of the sheet S is nipped by the switchback roller 121.

Figure 11:
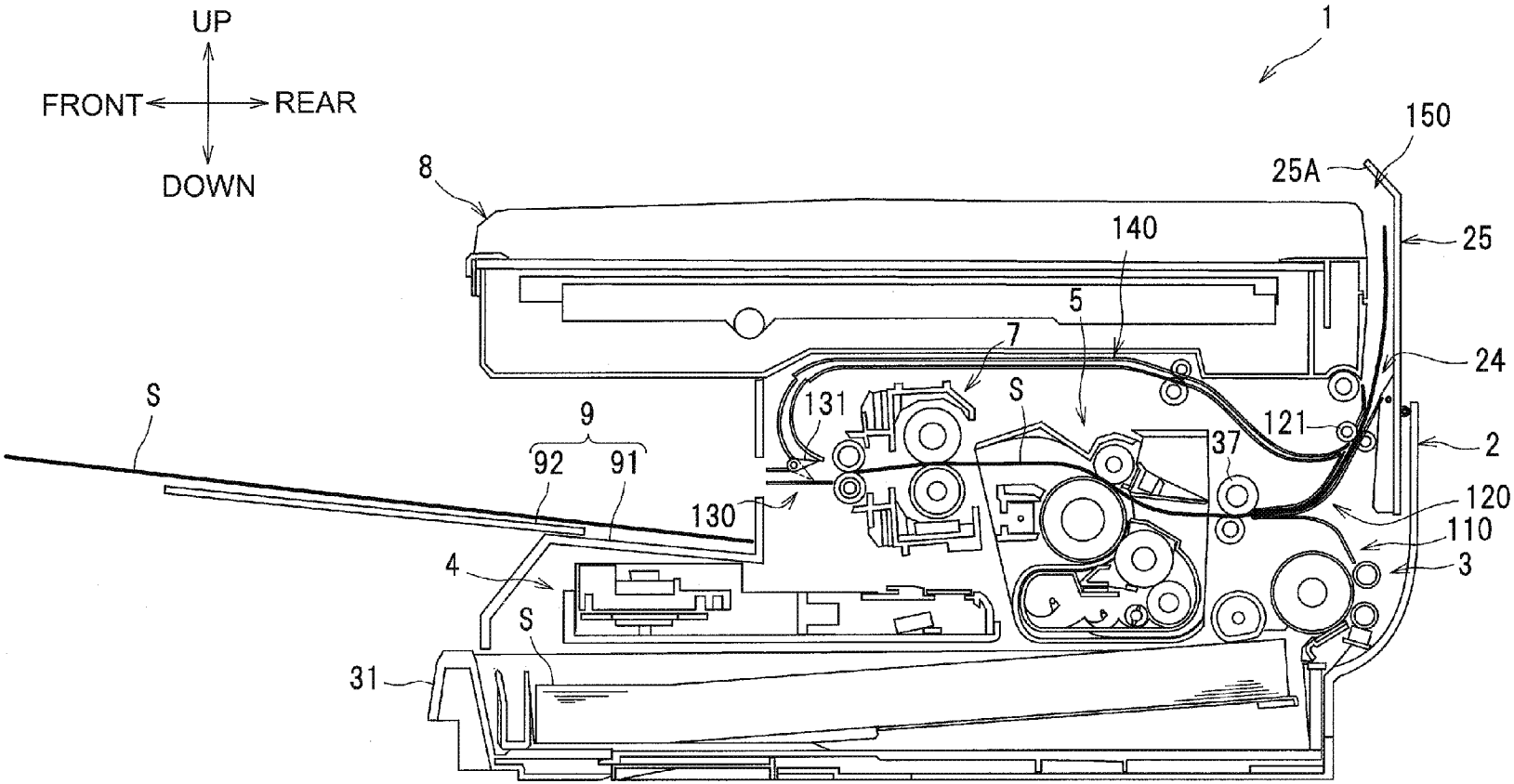
FIG. 11 is a view of the laser printer in which the sheet once discharged to the outside of the housing is conveyed again to a process unit.

As shown in FIG. 11, the sheet S is guided along the second feed path 120 toward the process unit 5 while the other side of the sheet S without an image faces down. When the sheet S is conveyed further, the process unit 5 transfers a toner image onto the other side of the sheet S, and the fixing unit 7 thermally fixes the toner image onto the sheet S. The sheet S having images formed on both sides thereof is discharged from the fixing unit 7, guided by the flapper 131 to the discharge path 130, and is discharged onto the discharge tray 9.

As described above, because the sheet S conveyed along the return path 140 is partially discharged through the manual insertion opening 24 to the outside of the housing 2 and then is conveyed toward the process unit 5, the length of the return path 140 can be reduced as compared with the structure in which a sheet is reversed upside down inside a housing. Thus, the size of the housing 2 and the size of the laser printer 1 can be reduced.

Because the sheet S discharged through the manual insertion opening 24 to the outside of the housing 2 is partially placed on the top cover 8, the sheet S discharged through the manual insertion opening 24 can be prevented from projecting greatly from the laser printer 1 to a surrounding area. This allows the laser printer 1 to be installed in a limited space, which is advantageous especially when the laser printer 1 is used with the tray 38 for A3-size sheets, as shown in FIG. 4.

Specifically, the laser printer 1 is configured such that the sheet discharged to the outside of the housing 2 is partially placed on the top cover 8, instead of being discharged rearward of the laser printer 1. Only an extra space is required for a projecting portion of the sheet S from the top cover 8. This allows the laser printer 1 to be installed in a limited space.

Further, the laser printer 1 is configured such that, when the sheet S is returned along the return path 140 toward the process unit 5, the sheet S conveyed along the return path 140 is once discharged to the outside of the housing 2 along the switchback path 150 and is partially placed on the top cover 8, and then is reversed, along the switchback path 150, to the inside of the housing 2 toward the process unit 5. Thus, the return path 140 defined inside the housing 2 can be relatively short and the size of the housing 2 can be prevented from excessively increasing.

The laser printer 1 according to the above-described embodiment has also the following advantages. As shown in FIG. 7, because a part of the return path 140 is formed in the top cover 8, the distance between the top cover 8 and the process unit 5 or the like can be reduced. This allows the laser printer 1 to have a duplex printing function without increasing the height of the laser printer 1. Specifically, because the second path 142, which is a part of the return path 140, is formed in the recess 84 of the top cover 8, the size of the laser printer 1 can be further prevented from increasing excessively.

As shown in FIG. 2, a part of the return path 140 is formed in a lower portion of the top cover 8 such that, when the top cover 8 is moved to the open position, the replacement opening 21 of the housing 2 is exposed. Opening the top cover 8 allows access to the process unit 5 for replacement.

As shown in FIG. 7, the developing agent storage 67 extends to a position right below the charger 52 which is disposed downstream of the downstream end 51E of the photosensitive drum 51. The amount of toner storable in the developing agent storage 67 can be sufficiently ensured without increasing the size in the front-rear direction of the laser printer 1.

As shown in FIG. 2, the process unit 5, which comprises the photosensitive unit 50 and the developing unit 60, is removably attached to the housing 2. Thus, the photosensitive unit 5, which requires relatively frequent replacements, and the photosensitive unit 50, which requires less frequent replacements, can be replaced at different times. Because one of the photosensitive unit 50 and the developing unit 60 can be selectively replaced, the cost of consumables and the environmental load can be reduced more as compared to the structure in which the entire process unit 5 is replaced or discarded. In short, the process unit 5 has an environmentally friendly structure.

As shown in FIG. 5, the second connecting wall 61C and the opposite wall 62C of the developing unit 60 serve as a conveying guide for guiding the sheet S properly in the process unit 5 toward the photosensitive drum 51. The developing unit 60 has a substantially L-shaped in the side view while the developing agent storage 67 is disposed below the photosensitive drum 51 and the conveying guide is disposed upstream of the photosensitive drum 51 in the sheet conveying direction. This prevents the size of the process unit 5 in the front-rear direction from increasing excessively.

The first connecting wall 61B is disposed as a handle in the frame 61. This improves the operability when the developing unit 60 is attached to and removed from the photosensitive unit frame 54.

Although, in the above-described embodiment, the developing unit 60 comprises the two frames, i.e., the first frame 61 and the second frame 62 movable relative to the first frame 61, the developing unit 60 is not limited to this structure. The developing unit 60 may comprise only a single frame as the photosensitive unit 50 does. Also, the conveying guide and the handle in the developing unit 60 in the above-described embodiment are shown just as an example. A handle may be formed into a substantially U-shaped by a pair of first frames 61 and a bar connecting ends (right ends in FIG. 5) of the first frames 61.

Although, in the above-described embodiment, the process unit 5 comprises the two units, i.e., the photosensitive unit 50 and the developing unit 60 removably attached to the photosensitive unit frame 54, a process unit may be made of a single unit into which a photosensitive unit 50 and a developing unit 60 are integrally formed so as not to be removable from each other. Alternatively, a process unit may be made of three or more units. For example, a developing unit 60 may be made of a developing chamber unit including a developing roller, and a developing agent storage unit removably attached to the developing chamber unit. A process unit may be made of these two units and a photosensitive unit.

Although, in the above-described embodiment, the process unit 5 is removably attached to the housing 2, the process unit 5 is not limited to this structure. A process unit may comprise a photosensitive unit and a developing unit as the process unit 5 in the above-described embodiment does, but only the developing unit may be removable from a housing.

The exposure unit 4 and the fixing unit 7 in the above-described embodiment are each shown as an example. An exposure unit may be an exposure head comprising an array of light-emitting diodes and disposed in proximity to a photosensitive drum. A fixing unit may be of the belt fixing type.

Although, in the above-described embodiment, the top cover 8 comprises the image sensor 83 and functions as a flat-bed scanner, the top cover may not function as a flat-bed scanner and may simply be a cover for opening and closing a replacement opening of a housing.

Although, in the above-described embodiment, the return path 140 is formed such that the sheet S discharged from the fixing unit 7 is guided toward the process unit 5 while passing above the fixing unit 7 and the process unit 5, a return path may be formed such that the sheet S discharged from a fixing unit is guided toward a process unit while passing below a fixing unit and the process unit.

Although in the above-described embodiment, the laser printer 1 is shown as an example of the image forming apparatus, the image forming apparatus may be a copying machine. Although A4-size sheets and A3-size sheets are each shown as an example of the sheets S, the sheets S may be OHP sheets.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

The invention claimed is:

1. An image forming apparatus comprising:

a housing having a first end and a second end, the first end being opposite to the second end;

an image forming unit configured to form an image on a sheet, the image forming unit including a photosensitive drum;

a forward convey guide configured to guide the sheet having the image formed thereon;

a switchback roller configured to change a rotation direction thereof and convey the sheet guided by the forward convey guide selectively in a forward direction and in a reverse direction;

a switchback guide configured to guide the sheet being conveyed by the switchback roller, the switchback guide having, at an end thereof, an ejection opening through which the sheet being conveyed by the switchback roller in the forward direction is partially ejected out of the housing;

a reverse convey guide configured to guide, toward the image forming unit, the sheet being conveyed by the switchback roller in the reverse direction;

a discharge roller disposed below an upper surface of the image forming apparatus and configured to discharge, out of the housing and in a direction toward the second end of the housing, the sheet having the image formed thereon; and a discharge tray configured to receive the sheet discharged by the discharge roller, wherein the ejection opening of the switchback guide is positioned above the upper surface of the image forming apparatus and open toward the second end of the housing, such that the sheet partially ejected through the ejection opening is conveyed horizontally along the upper surface of the image forming apparatus toward the second end, and wherein the switchback guide includes a first guide portion and a second guide portion disposed closer to the second end of the housing than the first guide portion, the first guide portion and the photosensitive drum being positioned on different sides of a forward convey path and the first guide portion and the photosensitive drum being positioned on a same side of a reverse feed path, and the forward convey path extending from the photosensitive drum to the ejection opening and the reverse feed path extending from the ejection opening to the photosensitive drum.

2. The image forming apparatus according to claim 1, wherein the switchback guide is disposed above the switchback roller and closer to the first end than to the second end of the housing.

3. The image forming apparatus according to claim 1, wherein the switchback guide includes a vertical portion disposed above the switchback roller, and a bent portion bent relative to the vertical portion and extending toward the second end of the housing.

4. The image forming apparatus according to claim 1, wherein the first guide portion is configured to pivot relative to the housing.

5. The image forming apparatus according to claim 1, further comprising a feed tray disposed below the image forming unit and configured to store sheets to be fed to the image forming unit.

6. The image forming apparatus according to claim 1, wherein the discharge tray is disposed below and inclined relative to the upper surface of the image forming apparatus.

7. The image forming apparatus according to claim 1, wherein the switchback roller and the discharge roller are disposed on opposite sides relative to the image forming unit.

8. The image forming apparatus according to claim 1, wherein the discharge roller is disposed closer to the discharge tray than to the switchback roller.

9. The image forming apparatus according to claim 1, further comprising a document reading unit disposed above the image forming unit.

10. The image forming apparatus according to claim 1, further comprising a cover, wherein the upper surface of the image forming apparatus corresponds to a top surface of the cover.

* * * * *